US008528840B2

(12) United States Patent
Lacher et al.

(10) Patent No.: US 8,528,840 B2
(45) Date of Patent: Sep. 10, 2013

(54) SANITARY WATER OUTLET

(75) Inventors: Wolf-Dieter Lacher, Mullheim (DE); Oliver Denzler, Bottmingen (DE); Alexander Stein, Ihringen (DE)

(73) Assignee: Neoperl GmbH, Mullheim (DE)

( * ) Notice: Subject to any disclaimer, the term of this patent is extended or adjusted under 35 U.S.C. 154(b) by 0 days.

(21) Appl. No.: 13/475,712

(22) Filed: May 18, 2012

(65) Prior Publication Data

US 2012/0228409 A1 Sep. 13, 2012

Related U.S. Application Data

(63) Continuation of application No. 11/817,457, filed as application No. PCT/EP2006/001944 on Mar. 3, 2006, now Pat. No. 8,205,810.

(30) Foreign Application Priority Data

Mar. 4, 2005 (DE) ..... 10 2005 010 550

(51) Int. Cl.
*E03C 1/08* (2006.01)
*B05B 15/08* (2006.01)
*B05B 1/14* (2006.01)

(52) U.S. Cl.
USPC ..... 239/428.5; 239/587.1; 239/587.5; 239/590.3

(58) Field of Classification Search
USPC ..... 239/428.5, 587.1–587.5, 589–590.5
See application file for complete search history.

(56) References Cited

U.S. PATENT DOCUMENTS

| | | | |
|---|---|---|---|
| 2,197,667 | A | 4/1940 | Shook |
| 3,067,953 | A | 12/1962 | Aghnides |
| 5,205,490 | A | 4/1993 | Steinhardt et al. |
| 6,126,093 | A | 10/2000 | Grether et al. |
| 2005/0156062 | A1 | 7/2005 | Thomas et al. |

FOREIGN PATENT DOCUMENTS

| | | |
|---|---|---|
| CH | 447964 | 3/1968 |
| DE | 1975191 | 12/1967 |
| DE | 1290498 | 3/1969 |
| DE | 7113198 | 8/1971 |
| DE | 3205205 | 8/1983 |
| DE | 102004039915 | 10/2005 |
| DE | 102005010550 | 3/2007 |
| EP | 1596014 | 11/2005 |

*Primary Examiner* — Darren W Gorman
(74) *Attorney, Agent, or Firm* — Volpe and Koenig, P.C.

(57) ABSTRACT

A sanitary insert (1) includes a housing (8) and a flow guide (4), the housing (8) having a generally cylindrical shape and an inner wall portion thereof has a concavity (3) around its periphery. The flow guide (4) having generally a disc shape with an outer wall portion thereof having a convexity (2), the housing (8) being configured to pivotally secure the flow guide (4) within it by a ball and socket type engagement thereby allowing an articulating movement of the flow guide (4) within the housing (8). The housing (8) being configured to be inserted into a plumbing outflow fitting.

11 Claims, 15 Drawing Sheets

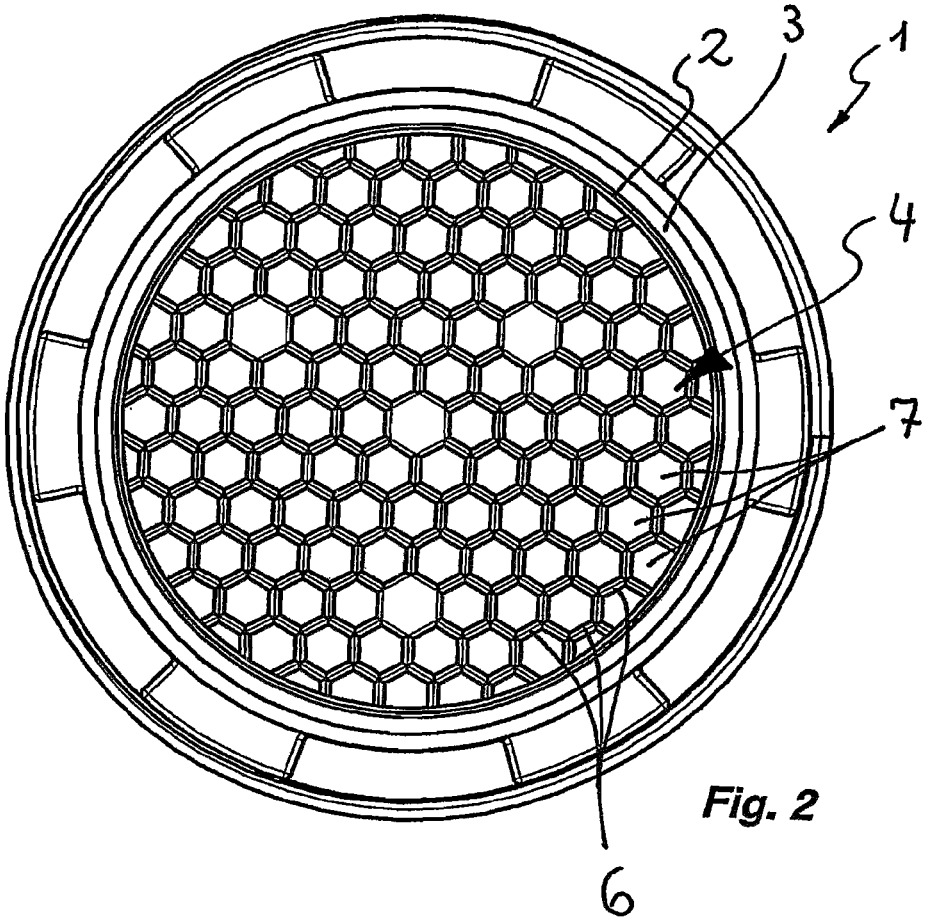
Fig. 2
Fig. 1
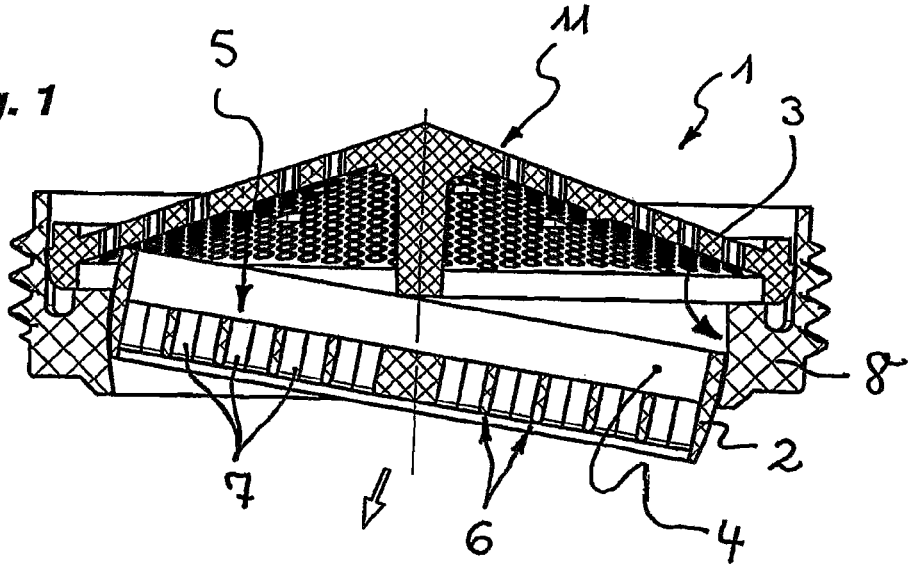

SANITARY WATER OUTLET

CROSS REFERENCE TO RELATED APPLICATION(S)

This application is a continuation of U.S. patent application Ser. No. 11/817,457, filed Aug. 30, 2007, which is a Section 371 National Phase of PCT/EP2006/001944, filed Mar. 3, 2006, which claimed priority to German Patent Application No. 102005010550.5, filed Mar. 4, 2005, the contents of all of which are incorporated by reference as if fully set forth.

BACKGROUND

The invention relates to a sanitary water outlet provided with a conduit, which conduit at the discharge end includes at least one perforated plate and/or a grid or lamellar structure with a number of outlet holes or outlet openings, bordered by flow guide walls, wherein the sanitary water outlet has a partial ball joint housing, that is arranged to be pivotable or positionable in a complementarily formed joint sleeve, and the flow conduit is provided by the inner housing of the joint sleeve.

Usually a jet regulator is provided at the water outlet of discharging sanitary fixtures, which is mounted via an outlet mouth piece to form a homogenous, bubbling-soft water jet. Here, jet regulators have been developed, which are provided downstream with a flow straightener, which aligns the individual jets created in the jet regulator approximately coaxially in reference to each other and is embodied, for example, as a perforated plate or as a grid or lamellar structure.

Frequently the problem arises that the water jet flowing into the outlet fixture is to be deflected into a different direction in the area of the water outlet. Therefore, ball-and-socket joints have been created comprising two joint sections, connected articulately, one joint section of which is connected to the water outlet of the water outlet fixture, and the other joint section carrying the jet regulator. Using such a ball joint, the water jet can be directed to the intended area, if necessary. However, such ball-and-socket joints have a relatively long longitudinal extension and require a lot of space which is not always available in every application. Additionally, these ball-and-socket joints change the external appearance, particularly in esthetically demanding water outlet fixtures. The externally located gap necessary for the mobility of such ball-and-socket joints of prior art also present a hygienic problem, because it is hard to clean or can not be cleaned at all.

It is known for example from DE 12 90 498 B for a tub filling arrangement provided outlet armature, to provide a ball-and-socket joint in the area of the water outlet. This ball joint includes an outlet armature mounted connection part that is connected in an articulated manner with an outflow side outlet part. The outflow part has an outlet side projection in which a flow regulator is provided. This known outlet armature has the previously described disadvantages for ball-and-socket joints.

From DE 32 05 205 A1, a sanitary outlet armature is known having an armature outlet, which on its free end outlet region includes a support surface for a ball-and-socket joint. The support surface is a cross-extending guide groove, in which a guide pin projecting axially from the ball is rotatably supported, so that the ball can only be rotated in a plane. The ball is held to the mounting surface via a holding piece, that is rotatably supported on the end region of the outlet armature. The ball-and-socket ball is through rotation of the holding piece through a between the holding piece and the outlet end piece provided control groove-control pin guide, pivotable rotatable so that the outlet direction of the water stream carried through the ball-and-socket ball by rotation of the holding piece can be altered.

This translates in an attendant requirement to rotate about the tube longitudinal axis and pivoting of the ball part about an axis perpendicular to the tube longitudinal axis of the outlet to translate positions, in a difficult to manufacture, closed and susceptible to dirt, kinematic arrangement. A further disadvantage is the extreme manufacturing requirements for the construction pieces as well as the many required pieces required. The large area occupied is a further disadvantage, which does not address the objective of a pivotably adjustable outlet stream that does not intrude aesthetically on the armature arrangement. It can be concluded that this known armature must be specially manufactured with the above requirements, so that the outlet armature is not useable in connection with a previously provided outlet armature.

From DE 19 75 191 U, a sanitary armature with an armature outlet is known in which through a corresponding formation on its outlet end, a roller formed flow regulator is pivotably supported. This roller formed flow regulator includes a free through-way, which is arranged in a cross-direction to a longitudinal axis of the roller formed flow regulator. In the free through way of the flow regulator, steam forming ribs are provided that divide the through way into individual outlet openings. With the help of this known armature outlet, the direction of the stream as well as the assembly of the flow regulator can be positioned and altered in order to, for example, to fill a bath tub or similar container. The roller formed flow regulator is only mounted for rotation in one plane in the armature outlet, limiting the possibilities for optimizing the flow direction.

SUMMARY

Therefore, the object is to provide a sanitary water outlet of the type mentioned at the outset which allows the water jet to be deflected without requiring a bulky ball-and-socket joint, potentially disrupting aesthetics, wherein the inventive water outlet is also useable in connection with previously installed sanitary outlet armatures.

This object is attained according to the invention in a sanitary water outlet of the type mentioned at the outset, in that the joint socket is provided on a outlet end area of the water outlet armature, in a sanitary water outlet armature outflow side mountable threaded housing, an outlet mouth piece or in a jet regulator housing, and that the in the housing interior of the joint sleeve provided flow conduit a perforated plate is provided, that has a plurality of outlet holes or openings bounded by flow guide walls.

The water outlet according to the invention is provided with a joint sleeve arranged in a joint sleeve in an adjustable or pivotal manner. Inside the joint sleeve, a conduit is provided having at least one perforated plate and/or grid or lamellar structure. The at least one perforated plate and/or grid or lamellar structure is provided with a number of outlet holes or outlet openings bordered by flow guide walls. Based on the joint sleeve being a spherical segment with two bases, it can be embodied with a comparatively short longitudinal extension. Here, it has shown surprisingly that such a conduit is able to deflect the water even in a comparatively short axial longitudinal extension of the conduit in the direction of the axial position of the flow guide walls. Here, bulky and potentially aesthetically disrupting ball-and-socket joints can be omitted. Because the joint socket is provided in a sanitary water outlet armature outflow side mountable threaded housing, an outlet mouth piece or in a flow regulator housing, an existing water outlet armature can be modified by threading such a part on the water outlet so that when required an adjustment of the outflow direction of water can be made, without the connection to the armature for directing-eventually through a work tool—the flow and direction of the water stream.

The conduit provided in the joint sleeve of the water outlet according to the invention can be provided with a lamellar structure, which deflects the water jet between the flow guide walls embodied as bars. However, an embodiment is preferred in which the outlet openings or outlet holes of at least one perforated plate of the conduit have holes with a round or polygonal cross-section. The flow guide walls of these round or polygonal outlet holes or outlet openings can be arranged comparatively close to each other and allow therefore good deflection of the water jet practically over its entire cross-section.

A particularly advantageous embodiment according to the invention provides for the outlet holes or outlet openings of at least one perforated plate to be arranged hexagonally and/or honeycomb-like or web-like in reference to each other.

One embodiment according to the invention provides that the joint socket is provided in a threaded sleeve that can be mounted downstream at a sanitary water outlet fixture or at an outlet mouth piece. By screwing on such a threaded sleeve or such an outlet mouth piece the water outlet can be changed even in already existing water outlet fixtures such that, if necessary, an alignment of the outflowing water jet is possible.

If necessary, it may be advantageous for the joint socket and/or the joint sleeve to be provided upstream with a jet regulator and/or an attachment screen or a similar sanitary insert. Here, an attachment screen can be provided upstream in order to prevent the conduit from becoming clogged by contaminating particles potentially entrained in the water. Using a jet regulator it is possible to form a homogenous, bubbling-soft water jet from the water flowing out of the water outlet.

A particularly advantageous further embodiment according to the invention comprises the joint socket being provided in a jet regulator housing. When such a jet regulator is inserted into conventional sanitary water outlet fixtures it is possible to subsequently align outflowing water without requiring a bulky and potentially aesthetically disrupting ball-and-socket joint.

In order to ensure that the joint socket always covers the open cross-section of the complementary shaped joint socket and that all the water flowing passes through the conduit it is advantageous for the pivotal motion of the joint sleeve in the joint socket to be bordered by a pivot stop.

In order to facilitate the flat embodiment of the water outlet according to the invention it is advantageous for the pivot stop here to be arranged upstream in reference to the joint sleeve.

A particularly simple and advantageous embodiment according to the invention provides that the pivot stop is formed by a downstream end of the jet regulator, attachment screen, or the like provided upstream in reference to the sanitary fixture.

In order to allow the conduit of the water outlet according to the invention in a simple manner to be brought from a pivotal position into its original normal position it is advantageous for the joint socket to be provided with at least one snapping means, which cooperates with at least one counter snapping means, and that the snapping and counter snapping means in their snapped position preferably define a normal pivotal position of the joint sleeve.

Here it may be advantageous for the joint socket to be provided with an encircling snapping groove, which cooperates at least with one snapping protrusion at the external perimeter of the joint sleeve. The snapping protrusion may for example encircle the external perimeter of the joint sleeve.

A preferred embodiment according to the invention provides, however, that at the external perimeter of the joint sleeve an even number of snapping protrusions is provided and that the snapping protrusions each are provided in pairs on opposite sides of a straight extending through the center of the joint sleeve. In this embodiment, the normal position of the joint sleeve can be found easily when the snapping protrusions engage the snapping groove. The snapping resistance can be easily overcome by pivoting the joint sleeve, with the snapping protrusions remaining in the snapping groove advantageously forming a rotational or pivotal axis.

In order to press a tapered joint sleeve in the form of a spherical segment having two bases in the flow direction into the spherical cap seat formed by the joint socket it is advantageous for the joint sleeve to be held or impinged via a return force arranged at its inlet end. Said return force, acting upon the joint socket, improves the running and/or friction features when adjusting the pivotal position of the joint sleeve. By the adjustment force acting manually against the spring force it is possible to release the joint socket such that the friction resistance during the adjustment is minimal. Without such a return force there is the risk that the joint sleeve is pressed against the flow direction into a joint socket allowing an easy jamming of the joint sleeve in the joint socket and aggravating the adjustment of the joint sleeve.

It is possible for the return force to be a helical spring or a membrane spring, which preferably impinges the joint sleeve at its upstream end.

It is advantageous for the perforated plate and/or grid and/or lamellar structure of the conduit to be provided upstream with at least one inserted or integrated part, which is embodied as a jet forming screen and/or acting a return force upon the joint sleeve.

Such an inserted or integrated part, embodied as a jet forming screen allows further improvement of the jet quality. When such an insertion or integrated part additionally or instead thereof acts as a return force upon the joint sleeve the running and/or friction features are improved during the adjustment of the pivotal position of the joint sleeve without requiring a special return spring.

The joint sleeve is particularly securely and well held in the complementary formed joint socket when the spherical segments of the joint sleeve pass through a central spherical plane.

BRIEF DESCRIPTION OF THE DRAWINGS

Additional features of the invention are discernible from the following description of an exemplary embodiment of the invention in connection with the claims and the drawing. The individual features can here be implemented individually or combined in an embodiment according to the invention.

In the drawings:

FIG. 1 a joint sleeve embodied as a threaded sleeve with spherical segment joint socket in which the joint sleeve is pivotably mounted, with the joint socket and the joint sleeve being components of a sanitary water outlet, FIG. 2 the joint socket and joint sleeve of FIG. 1 in a top view provided in the joint sleeve at the downstream side of a conduit, with the conduit having a perforated plate, with its outlet openings having a hexagonal open cross-section and being arranged honey-comb shaped in reference to each other, FIG. 3 a water outlet comparable to FIGS. 1 and 2, embodied here as an outlet mouth piece, which can be mounted with an internal thread to the external thread of a sanitary water outlet fixture, with a jet regulator being held in the outlet mouth piece with an upstream attachment screen and with the outlet mouth piece downstream having a spherical joint socket, in which joint sleeve is arranged in a pivotal manner, FIG. 4 the conduit of an outlet mouth piece comparable to FIG. 3 with the conduit here being provided with a perforated plate having outlet openings or outlet holes embodied as segments of circles, FIG. 5 a conduit comparable to FIG. 4, here the outlet holes or outlet openings having a square open cross-section, though, FIG. 6 an outlet mouth piece provided merely to accept a joint socket and the respective joint sleeve, FIG. 7 the outlet mouth piece of FIG. 6, with the joint sleeve being arranged in a pivotal position in the joint socket, FIG. 8 an outlet mouth piece comparable to FIGS. 6 and 7, however, here with an external thread FIG. 9 the outlet mouth piece of FIG. 8 showing a pivotal position of its joint sleeve, FIG. 10 the outlet mouth piece forming the water outlet of a sanitary water fixtures with a jet regulator with a jet regulator housing being inserted into the outlet mouth piece accepting a jet splitting part inside its jet sleeve and being provided with a joint socket downstream, in which joint socket a joint sleeve provided with a conduit is arranged in a pivotal manner, FIG. 11 a jet regulator housing comparable to FIG. 10, with the jet regulator housing in the area of its joint socket having three circulatory snapping grooves at a distance from each other, which cooperate with a snapping protrusion arranged a the external perimeter of the joint sleeves, with the snapping grooves of the joint socket defining the neutral position of the joint sleeve and at both sides the external pivotal positions of the joint sleeve, FIG. 12 the jet regulator housing of FIG. 11 also in longitudinal cross-sectional showing a detailed representation in the area of the contact region between the joint sleeve and the joint socket, FIG. 13 a jet regulator housing comparable to FIGS. 11 and 12, with the joint socket here having only one snapping groove predetermining a neutral position, which the joint sleeve can engage with a protruding snapping protrusion at the external perimeter at the joint sleeve, FIG. 14 a snapping protrusion of the joint sleeve engaging the snapping groove of the joint socket, FIG. 15 the joint sleeve provided for an outlet mouth piece according to FIG. 13, here carrying a ring-shaped encircling snapping protrusion, FIG. 16 a joint sleeve comparable to FIG. 15 however provided with an even number of snapping protrusions allocated to each other in pairs located at opposite sides of the joint sleeve, FIG. 17 a jet regulator housing comparable to FIG. 13 that can be inserted into an outlet mouth piece, which downstream carries a joint sleeve shown in its pivotal position, FIG. 18 a jet regulator housing comparable to FIG. 17, with the joint sleeve shown in its pivotal position being inserted into an inserted part embodied as a jet formation screen and located upstream in reference to the perforated plate of the conduit, simultaneously executing a return force upon the joint sleeve, FIG. 19 a jet regulator housing comparable to FIG. 18, with the return force here being applied to the joint sleeve via a helical spring, FIG. 20 a jet regulator housing that can be inserted into an outlet mouth piece, carrying a joint socket downstream, in which joint socket a joint sleeve is supported pivotally and rotational in a circumferential direction, with the pivotal axis of the joint sleeve being determined by two spacers set apart from each other and pivotally contacting upstream the plate-shaped insertion part, which at their free end sections have a semicircular external contour, FIG. 21 a jet regulator housing comparable to FIG. 20, in which the spacers, provided upstream from the perforated plate in the joint sleeve, have a polygonal external contour, with snapping protrusion being provided at said external contour each sensibly defining a pivotal position of the joint sleeve, FIG. 22 a jet regulator housing with the joint sleeve contacting with its upstream circumferential edge region under stress the internal perimeter of the joint socket in a sealing manner, FIG. 23 a jet regulator housing with longitudinal grooves being provided at the housing section or housing part supported pivotal around the longitudinal axis and/or in the circumferential direction and having a joint socket, into which pivotal pins engage protruding from the opposite sides of the joint sleeve and defining a pivotal axis of the joint sleeve, FIG. 24 a jet regulator housing, with its joint sleeve located inside the housing being supported pivotal and rotational in a joint socket of the jet regulator housing, with a central spacer, embodied in a pin or bar shape, protruding from the joint sleeve and/or the component located upstream thereof determining the pivotal and rotational axis of the joint sleeve, and FIG. 25 a jet regulator housing having a joint socket with a cone-shaped interior located at the downstream end-section of the housing, in which a spherical cap-shaped joint sleeve is held in a mobile fashion.

DETAILED DESCRIPTION OF THE PREFERRED EMBODIMENTS

Figure 4:
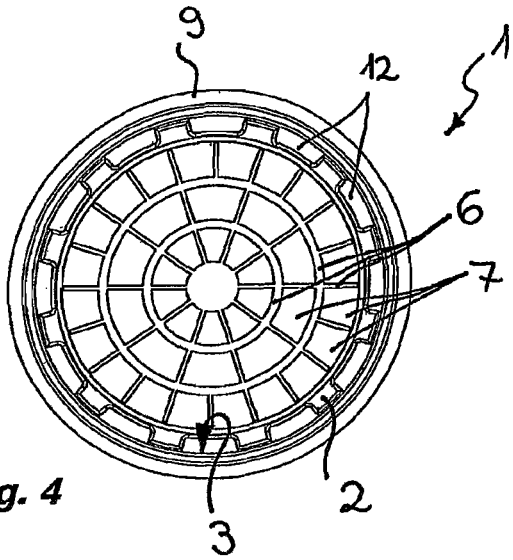
Figure 5:
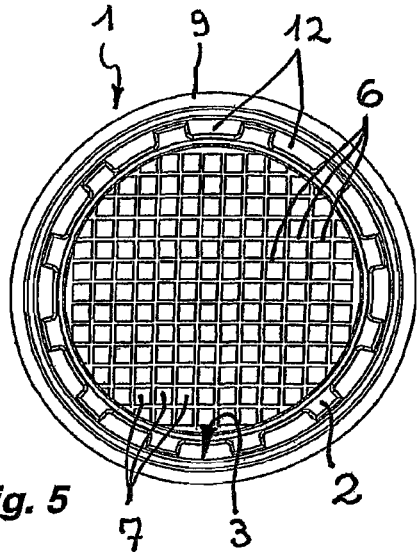

In FIGS. 1 through 25 various embodiments of a sanitary water outlet 1 are shown. The water outlets 1 shown here are provided with a spherical segment with two bases forming the joint sleeve or convexity 2, arranged in a joint socket or concavity 3 to be adjustable or pivotal in the manner of a ball-and-socket joint.

Inside the sheath of the joint sleeve 2, a generally disc-shaped conduit or flow guide 4 is provided having a perforated plate 5 with a number of outlet holes or outlet openings 7 bordered by flow guide walls 6.

Based on the spherically shaped segment of the joint sleeve 2, it can be embodied with a relatively short longitudinal extension. Here it has shown surprisingly that such a conduit is able to deflect water even in a relatively short axial longitudinal extension of the conduit in the direction of the axial position of the flow guide walls. Through this, voluminous and potentially aesthetically disturbing ball-and-socket joints can be omitted.

Figure 3:
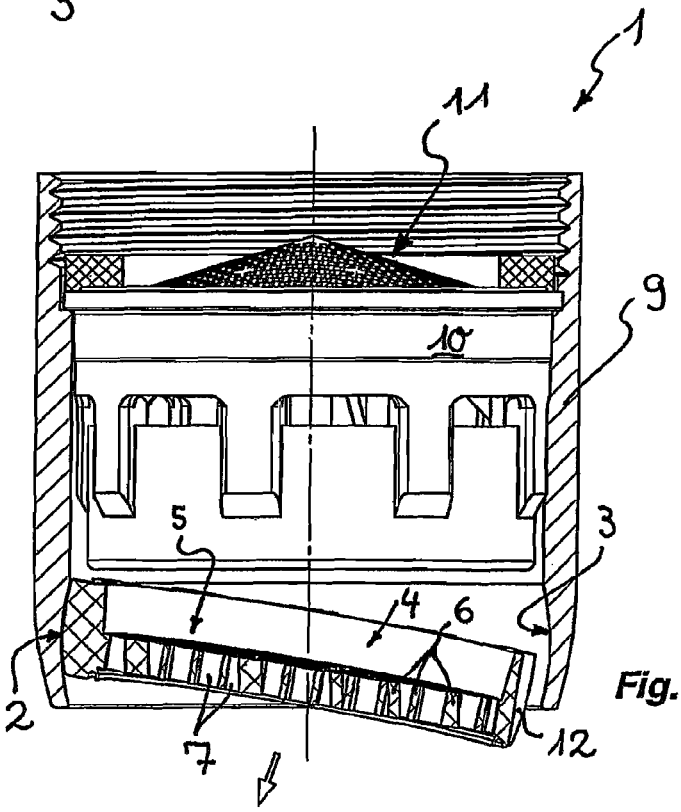

The outlet holes of the conduits 4 shown in FIGS. 1 through 3 as well as 6 through 25 are provided with a polygonal and particularly hexagonal opening cross-section and are arranged in a honey-comb shape in reference to each other. As discernible from FIG. 4, the outlet openings may also be embodied as segments of circles, bordered by radial or concentrically surrounding flow guide walls 6. From FIG. 5 it is discernible that the outlet openings may also be provided with a round or, as shown here, a rectangular open cross-section.

In FIG. 1 it is discernible that the joint socket 3 may be provided in a sleeve or a rosette 8 which can be screwed in. This threaded sleeve 8 is screwed into the water outlet 1 of a sanitary water outlet fixture such that the threaded sleeve 8 can be inserted entirely into the water outlet.

FIG. 3 shows an outlet mouth piece 9, which can be fastened to a common sanitary water outlet fixture. A jet regulator 10 with an upstream attachment screen 11 can be inserted into the outlet mouth piece 9, which is to form a homogenous bubbling-soft water jet and here additionally shall aerate it. The outlet mouth piece 9 is provided at its downstream facing end with a joint socket 3, into which the conduit 4 provided with the joint sleeve 2 is held in a pivotal and rotational manner. Here, it is also discernible from a comparison of FIG. 3, on the one hand, with FIGS. 4 and 5, on the other hand, that recesses 12 or similar formations are provided at the external perimeter of the joint sleeve 2 allowing air to enter the jet regulator 10.

Figure 6:
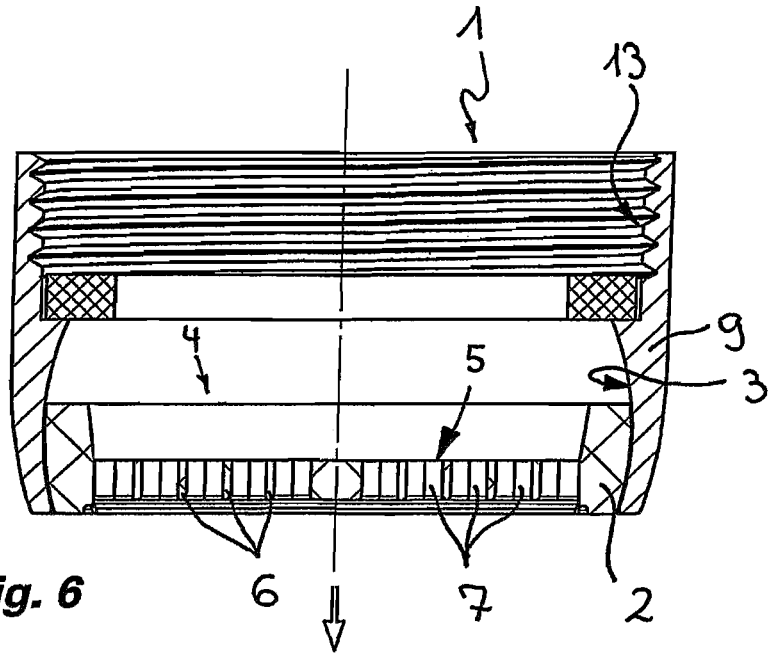
Figure 7:
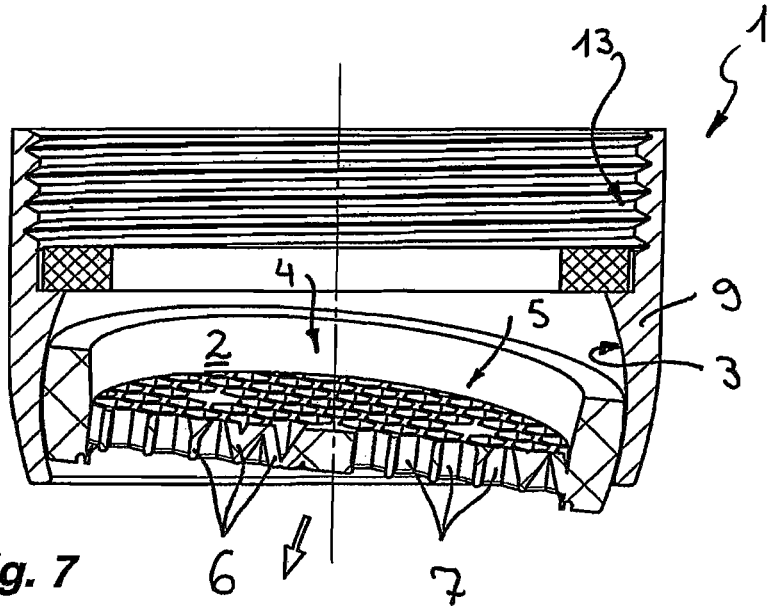

FIGS. 6 and 7 show an outlet mouth piece 9, which is to include a joint socket 3 and the corresponding joint sleeve 2. This outlet mouth piece 9 according to FIGS. 6 and 7 can be mounted with an internal thread 13 at the external thread of a sanitary water outlet fixture not shown in detail, here.

Figure 8:
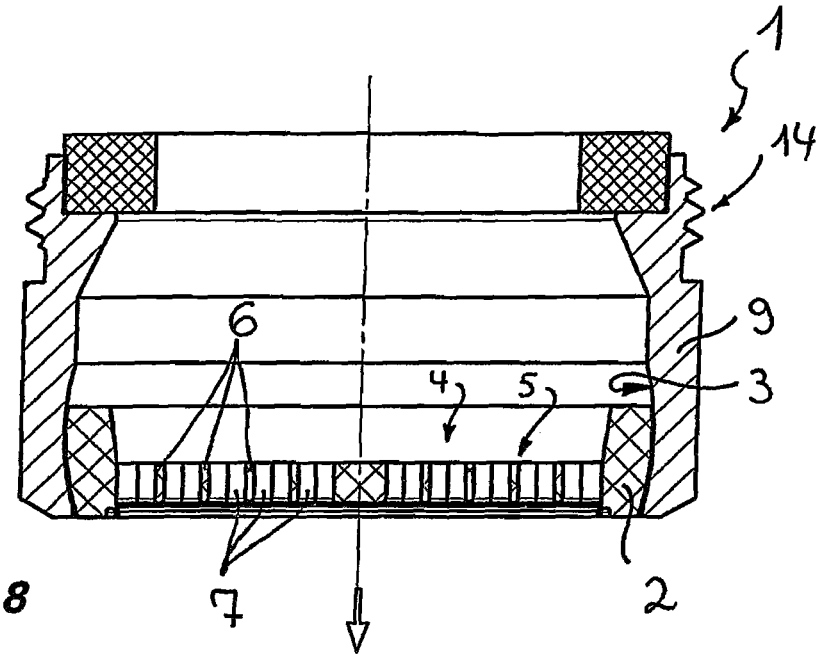
Figure 9:
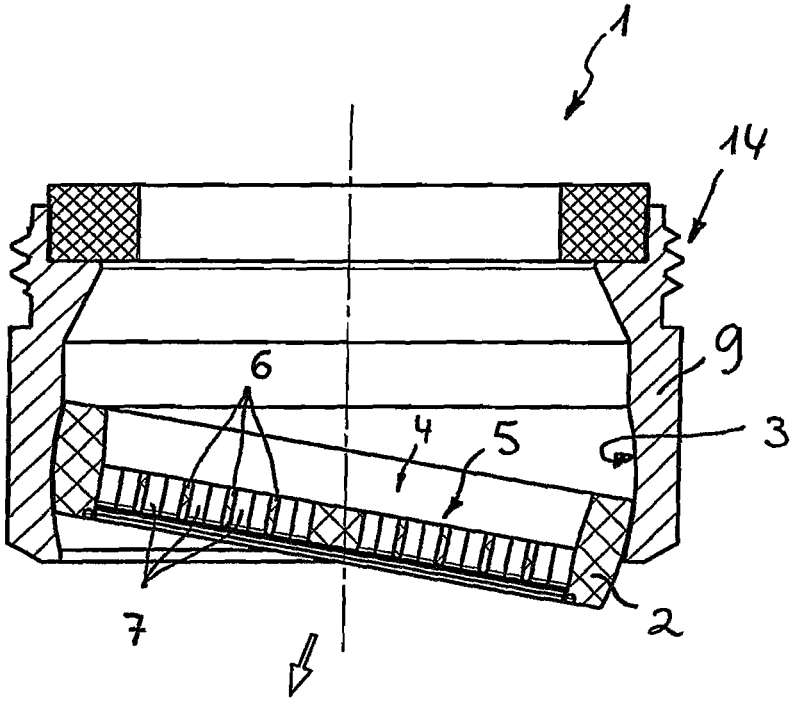

FIGS. 8 and 9 show an outlet mouth piece 9 comparable to FIGS. 6 and 7, which here carries an external thread 14 to screw it to a sanitary water outlet fixture.

Figure 10:
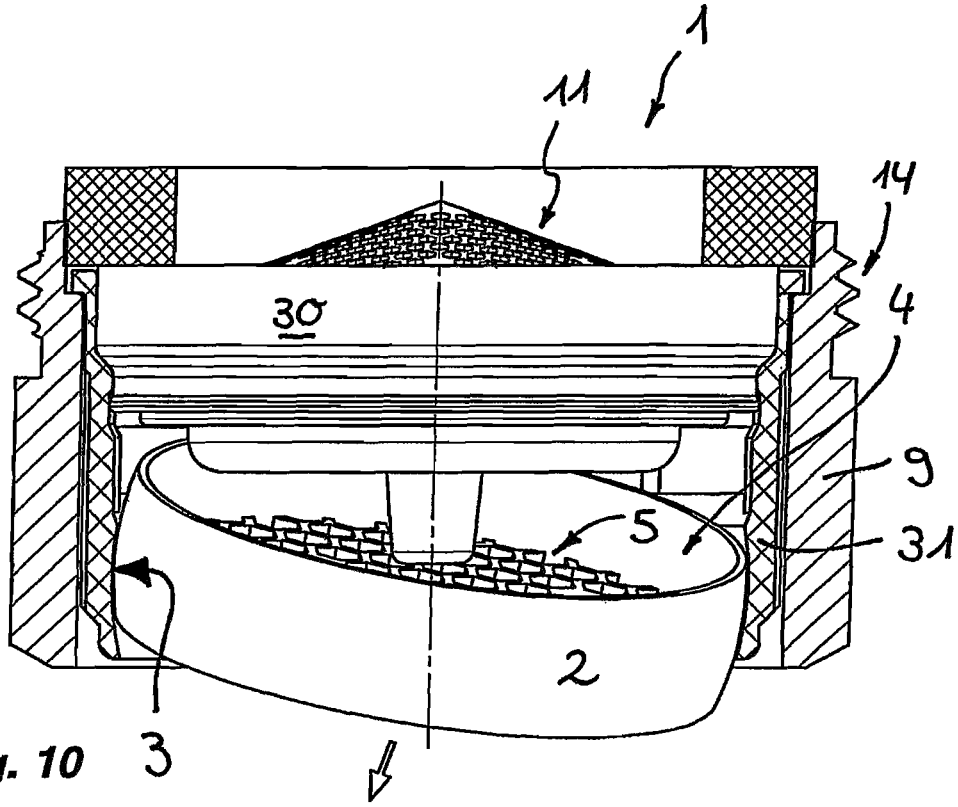

In FIG. 10 an outlet mouth piece 9 is shown, which also carries an external thread 14 to screw it into the internal thread of a water outlet fixture. A jet regulator housing 31 can be inserted in the outlet mouth piece 9, with a jet splitting insert 30 being inserted into the interior of its sleeve. The jet regulator housing 31 is provided downstream with the joint socket 3, in which the joint sleeve 2 is held in an adjustable or pivotal manner.

From FIGS. 11 through 16 it is discernible that the joint socket 3 is at least provided with a snapping means 17, cooperating with at least one counter snapping means 18 at the external perimeter of the joint sleeve 2. Here, snapping and counter-snapping means 17, 18 determine in their snapping position, for example, the normal pivotal position of the joint sleeve. While the joint socket 3 has an encircling snapping groove 17 for this purpose, a ring-shaped encircling snapping protrusion 18 can be provided at the external perimeter of the joint sleeve 2, shown in greater detail in FIG. 15.

Figure 16:
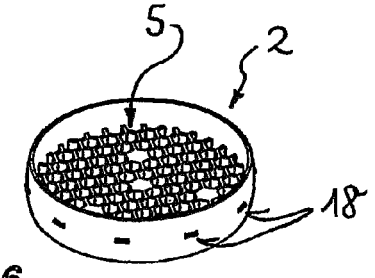
Figure 15:
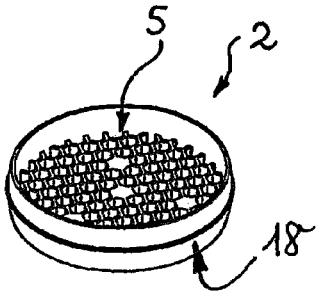

As discernible from FIG. 16 it is also possible for an even number of snapping protrusions 18 to be provided at the external perimeter of the joint sleeve 2, which are provided in pairs each on opposite sides of a straight extending through the center of the joint sleeve.

Figure 11:
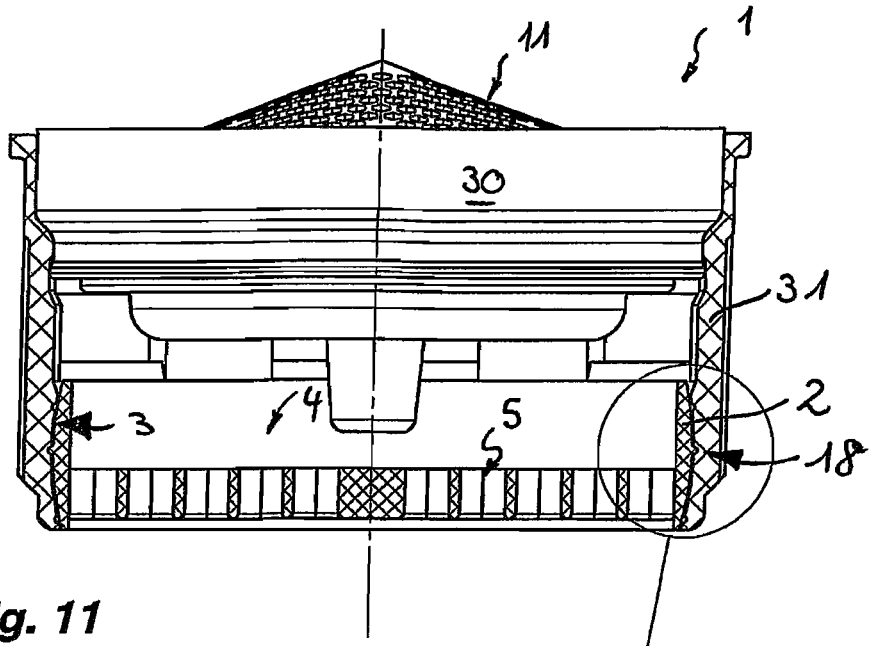
Figure 12:
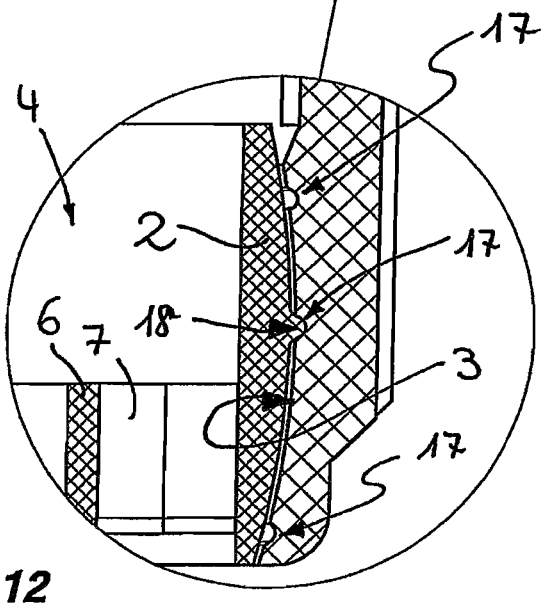
Figure 13:
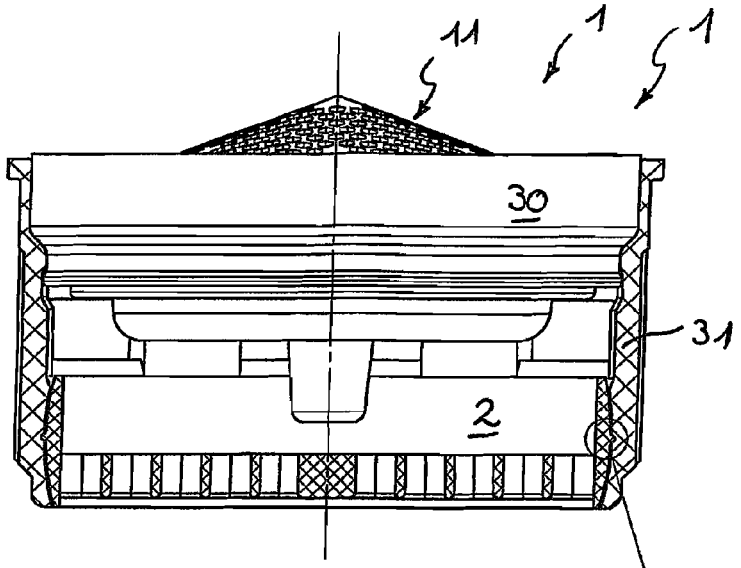
Figure 14:
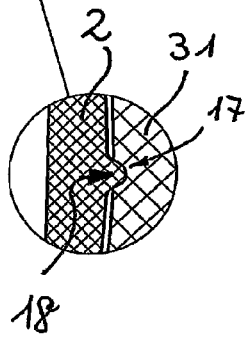

The jet regulator housing 31 shown in FIGS. 11 and 12 is provided with a joint socket 3, having 3 snapping grooves 17 distanced from each other. At least one snapping protrusion 18 can engage the snapping groove 17, arranged on the spherical central level of the joint sleeve. Here, the snapping grooves 17, spaced apart from each other, determine the normal pivotal position and the pivotal positions of the joint sleeve 2 at both external sides.

From a comparison of FIGS. 1, 3, 7, 9, 10, and 17 through 25 it is discernible that the pivotal motion of the joint sleeve 2 in the joint socket 3 is limited by a pivotal stop, which is arranged at the upstream end of the joint sleeve 2. This pivotal stop is here formed by the downstream end of an attachment screen (cf. FIG. 11), a jet regulator (cf. FIGS. 3, 6 through 10, 17 through 19, and 20 through 25) or a similar upstream arranged sanitary insertion part.

Figure 17:
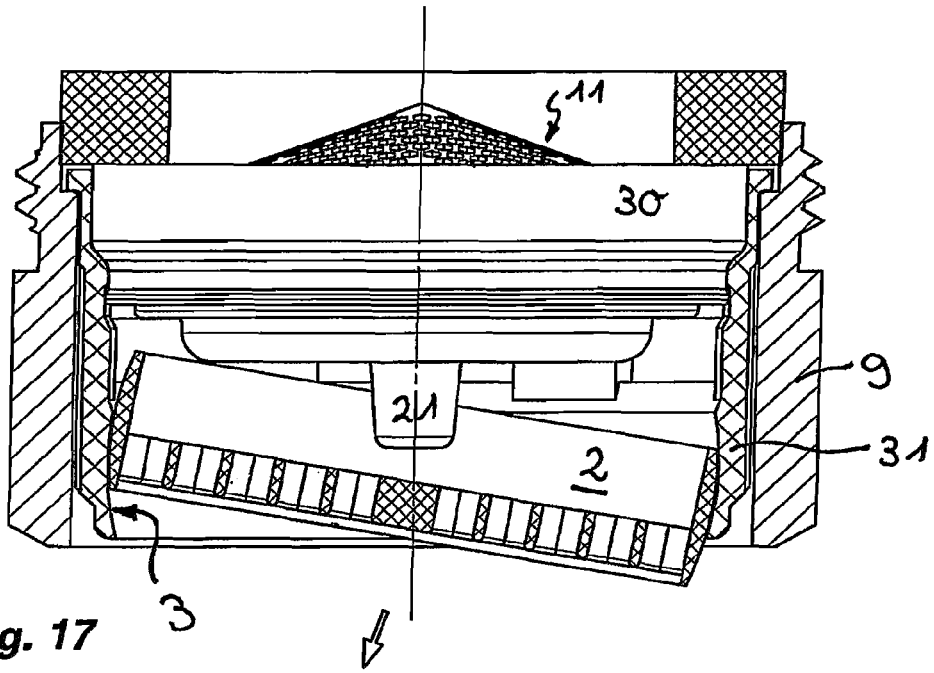
Figure 18:
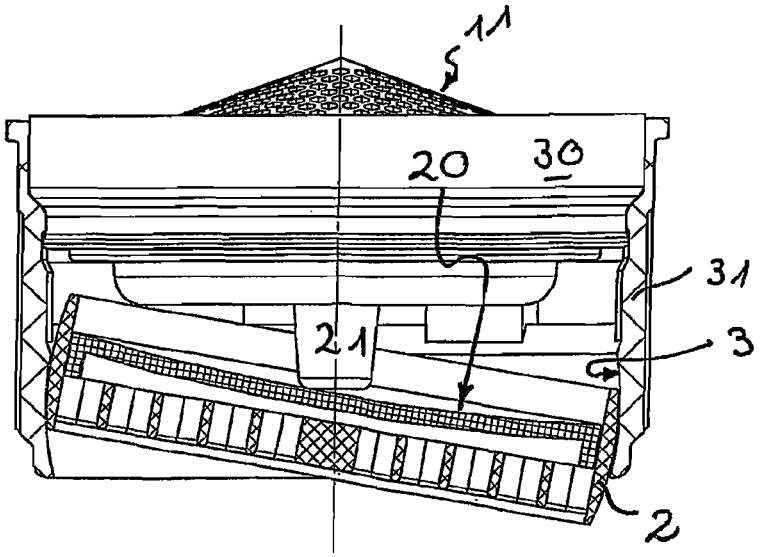
Figure 19:
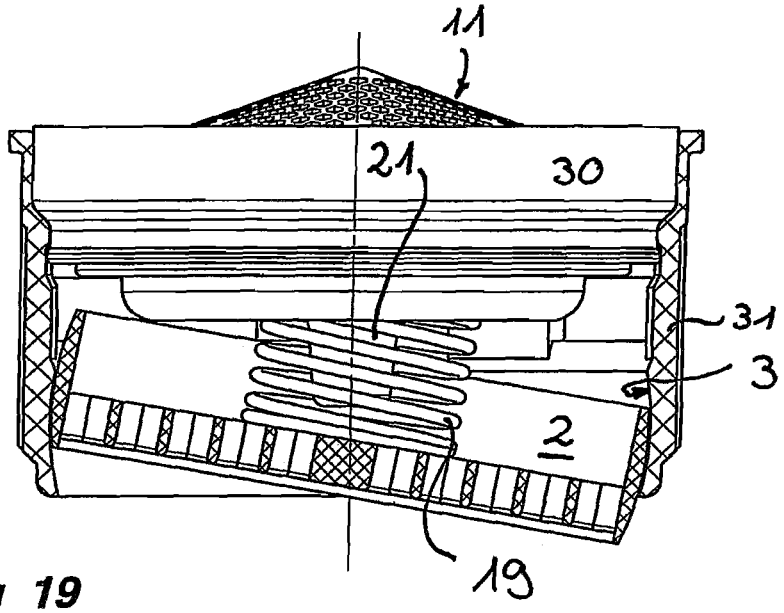

From the comparison of FIG. 17, on the one hand, with FIGS. 18 and 19, on the other hand, it is discernible that the joint sleeve 2 can also be held or impinged by a return force in the joint socket 3, arranged at its upstream end. In the exemplary embodiments shown in FIGS. 18 and 19 this return force is applied by a helical spring 19 (cf. FIG. 19) or an inserted or implemented part 20 upstream in reference to the perforated plate 5 (cf. FIG. 18), which simultaneously may be embodied as a jet forming screen, in order to additionally improve the jet quality. Here, at the jet splitting insert or a similar jet regulator part provided upstream, a central protrusion 21 is provided, encompassing the helical spring 19 or impinging the inserted or implemented part 20 in a spring-like manner. This return force presses the joint sleeve 2 downwards into the cap-shaped seat formed by the joint socket 3, by which the running and/or friction features are improved during the adjustment of the pivotal position. By the manual adjustment force acting against the return force it is possible to release the joint sleeve 2 such that the friction resistance during the adjustment is minimal. Without the return force provided here there is the risk that the joint sleeves 2 are pressed against the upper internal perimeter of the joint socket 3, thus allowing the joint sleeves 2 easily to jam and aggravating any further adjustment.

Furthermore, the return force acting upon the joint sleeve 2 increases its friction in the joint socket 3, additionally securing the joint sleeve 2 in the adjusted position and preventing an automatic return, for example by the water flowing through it. A pre-stress of the joint sleeve 2 and the joint socket 3 simultaneously increases the sealing effect in the motion area in reference to water leaking in a disturbing manner. It is understood that the return force can also be achieved by other spring-loading elements and constructions.

The inserted or implemented part 20 used in FIG. 18 is advantageous, though, in that the jet quality of the water flowing through the conduit 4 is additionally improved. The joint sleeve can have a thickness ranging from 1 to 15 mm. The spherical, general adjustability of the joint sleeve 2 also allows to always direct the water jet such that when it impinges a sink it tends to splash as little as possible.

Figure 20:
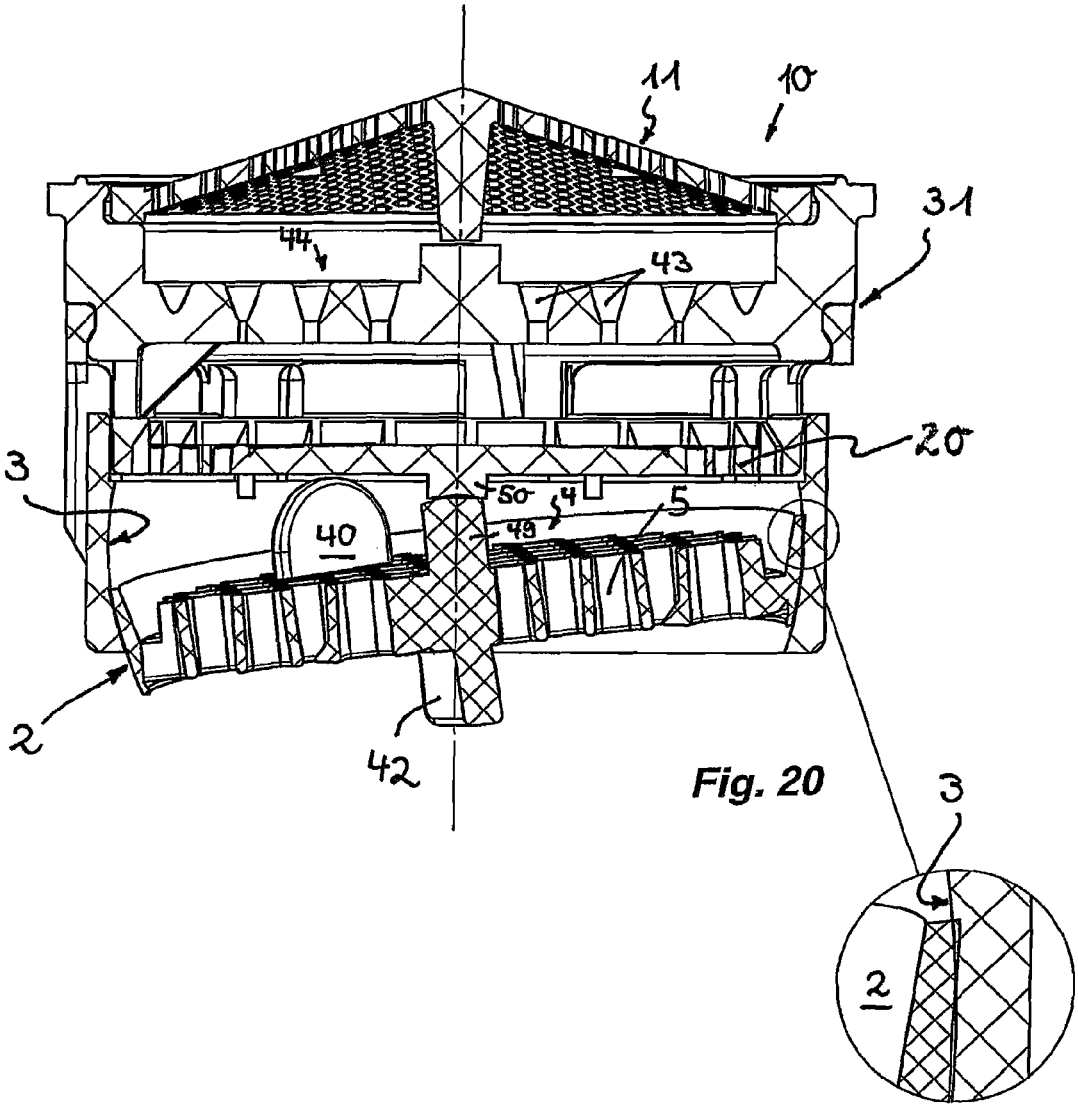

In FIG. 20, the jet regulator housing 31 of a jet regulator 10 that can be inserted into an outlet mouth piece is shown provided with the joint socket 3 at the downstream end section of the housing, in which the joint sleeve 2 is located in a pivotal and rotational manner. Here, the joint sleeve 2 can only be pivoted in one plane. This is enabled by two spacers 40, semi-circular at their free end section, between the joint sleeve 3 and the inserted or implemented part 20 positioned thereabove, which is embodied here as a disk or plate-shaped part 20 provided with flow openings. In the cross-section of FIG. 20 only one of the two spacers 40 is discernible. In order to adjust the joint socket 2 the semi-circular external perimeter of the two spacers 40 roll on the disk-shaped part 20 located thereabove. A movement of the joint sleeve perpendicular in reference to this preferred motion is not possible, therefore the joint sleeve 2 can only be pivoted in a plane parallel in reference to the spacers 40. The preferred direction of this single pivotal plane can be set by the user by rotating a rotation bar 42 serving as a handle and located downstream at the jet regulator fixed by screwing at the sanitary outlet fixture. In FIG. 20 it is discernible that this rotation bar 42 has a longitudinal extension approximately coaxial and axially parallel in reference to the pivotal axis of the joint sleeve 2. The rotation bar 42 therefore also serves as an indicator showing the user in which axis and/or in which plane the joint sleeve 2 embodied as a pivotal disk can be moved. The rotation bar 42 not only allows to pivot the joint sleeve 2 in the predetermined plane, rather the joint sleeve 2 held pivotal in the circumferential direction in the joint socket 3, can also be rotated at the rotation bar 42, when the user intends to change the pivotal direction of the joint sleeve 2.

The detailed representation in FIG. 20 shows the sealing of the joint sleeve 2 in reference to the joint socket 3. The overlap of these two parts 2, 3 shown here does not occur in reality, however it is illustrated to show the undeformed size (prior to assembly) of the joint sleeve 2 and the joint socket 3. Through use of this illustrated overlap, in reality elastic and plastic deformation occurs allowing a durable seal.

Figure 21:
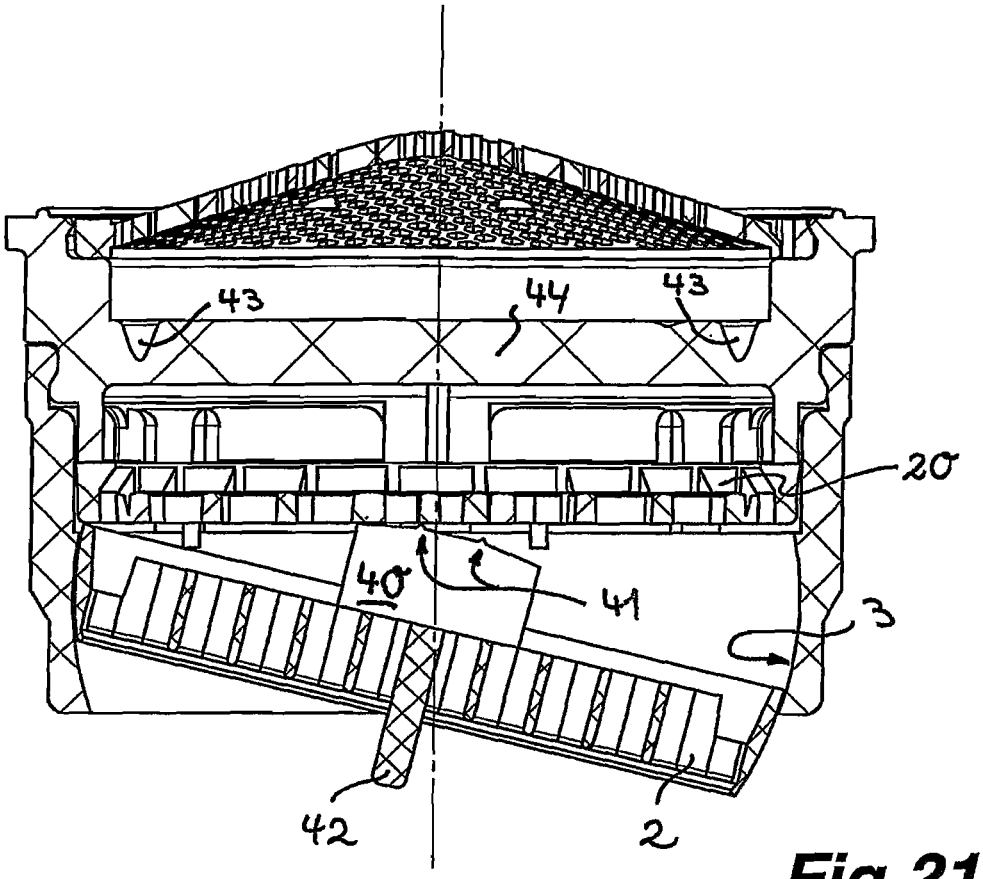

The jet regulator housing 31 shown in FIG. 21 is provided with a joint sleeve 2, having a similar, unilateral mobility as the joint sleeve 2 in FIG. 20. The two aligned spacers 40 show at their free end section a polygonal external contour, which rolls during the pivoting of the joint sleeve 2 around the axis perpendicular in reference to the plane of the drawing on the disk or plate-shaped part 40 located thereabove. The polygonal external contour is characterized by additional snapping protrusions 41 or similar elevations. These snapping protrusions 41 allow "intermediate snap positions" so that the user is signaled by various resistances during movement that the adjustment occurs gradually. For reasons of completeness, it is mentioned that the splitting bores 43 of the upstream jet splitter 44 also embodied as a perforated plate are not located in the cross-sectional plane here, thus only two of these splitter bores 43 are partially shown and only indicated.

In FIGS. 20 and 22 through 25 it is discernible that the joint sleeve 2 is provided with a central spacer 49 supported at the above inserted or implemented part 20. The inserted or implemented part 20, allocated upstream, is provided with an also pin or bar shaped protruding spacer 50, so that the spacers 49, 50 impinge each other at their free face ends. Here, the upstream provided inserted or implemented parts 20 acts a return force upon the joint sleeve 2, which return force presses the joint sleeve 2 into the joint socket 3.

Figure 22:
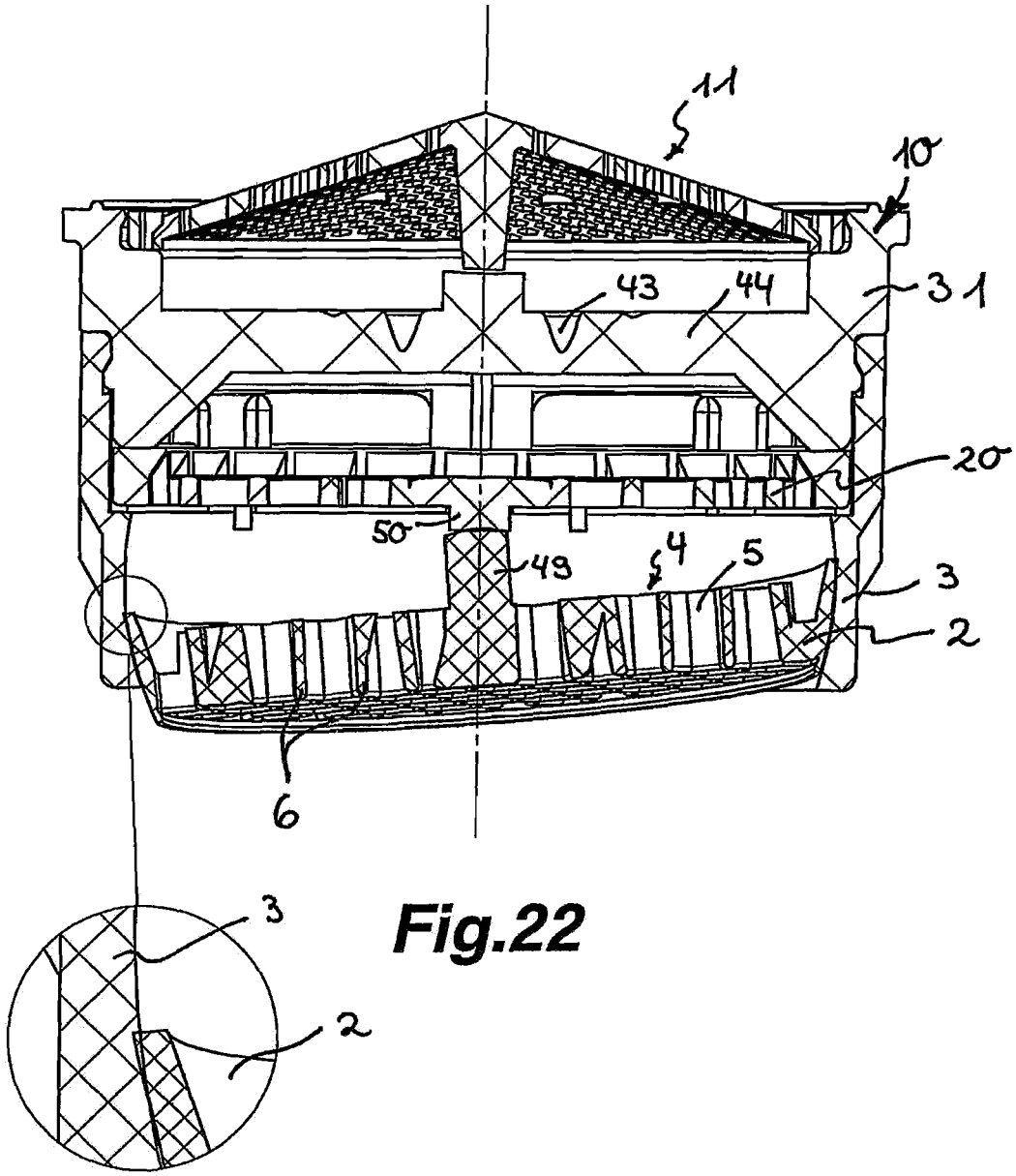

FIG. 22 shows a jet regulator 10 also embodied as a pivotal jet regulator, in an embodiment pivotal to all sides. The enlarged detailed representation in FIG. 22 allows the overlapping of the two corresponding and sealing parts 2, 3 to be seen. This overlap is a theoretical representation. In practical operation here a pre-stressed contact of the joint sleeve 2 to the joint socket 3 occurs, ensuring a tight seal. Due to the seal, the extent of this contact is important for the adjustment moments and/or the adjustment force, because said adjustment, on the one hand, shall be evenly easy or hard to move over all pivotal positions of the joint sleeve 2. On the other hand, this contact also ensures that the joint sleeve 2 is displaced as little as possible over the life of the product.

Figure 23:
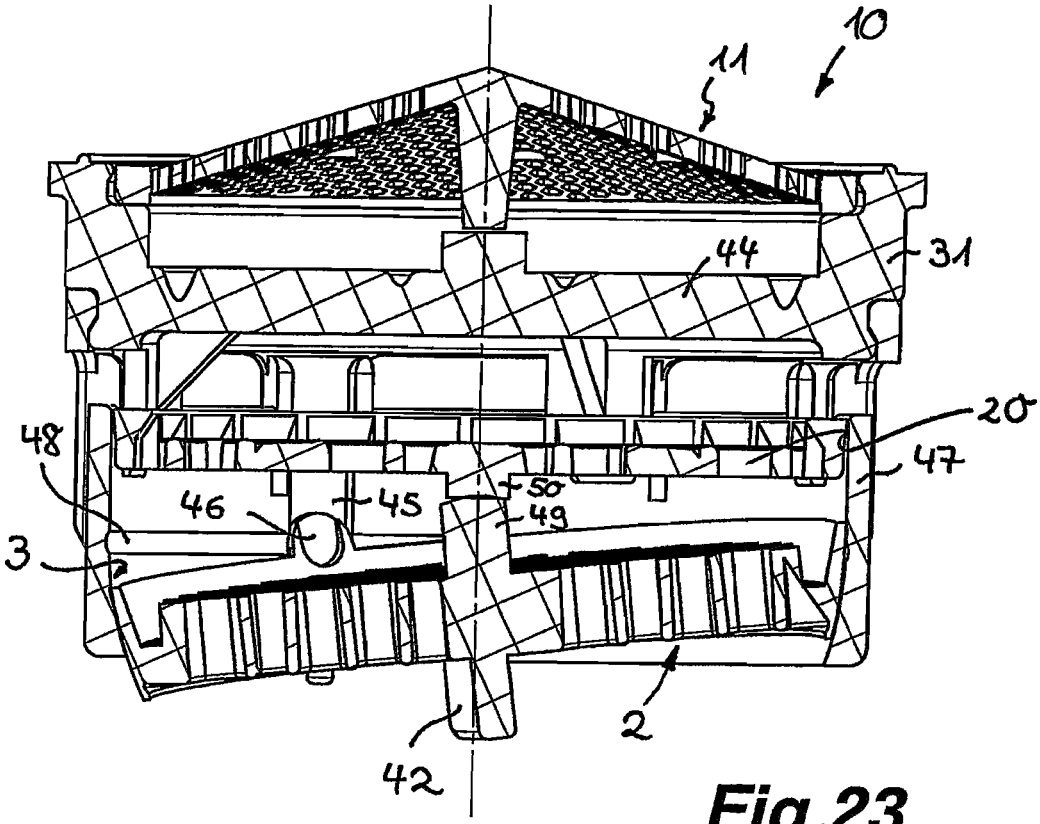

FIG. 23 also shows a joint sleeve 2 pivotal in only one plane. The adjustment of the joint sleeve 2 of the pivotal jet regulator 10 shown in FIG. 23 occurs, as in the above explanations in FIGS. 20 through 22, via the rotation bar 42 at the downstream end. The difference between the previous FIGS. 20 through 22 is here the pivotal axis of the joint sleeve 2 being formed by two longitudinal grooves 45 at the internal perimeter of the jet regulator housing 31 and its joint socket 3, in which the joint sleeve 2 with the pivotal bar 46 is supported. In order to adjust the pivotal level the joint sleeve 2 can be rotated at the downstream, outwardly protruding rotation bar 42 or the bottom 47 of the housing of the jet regulator housing 31, carrying the joint sleeve 2 and the jet forming perforated plate in the accepting joint socket 3, is rotated around the longitudinal axis of the jet regulator 10. In FIG. 23, it can be seen that the neutral position of the joint sleeve can be realized in the form of a groove 48 encircling the bottom 47 of the housing. When the joint sleeve 2 is in the neutral position, the upper free end of the elastically formed upstream circumferential edge of the joint sleeve 2 engages the slight undercut of the encircling groove 48.

Figure 24:
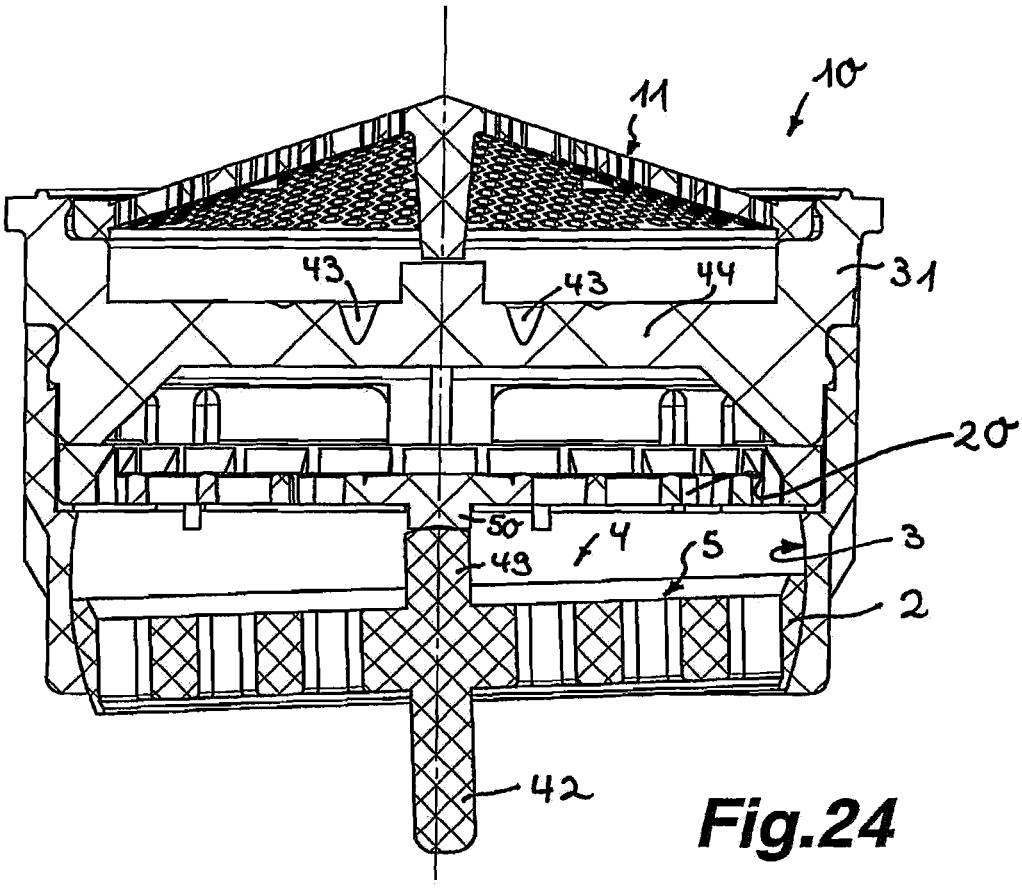

FIG. 24 shows the embodiment of a jet regulator with the joint sleeve 2 being mobile in all directions and provided at the downstream end with an adjustment pin or rotational bar 42, so that an adjustment of the joint sleeve 2 can occur by the user via grasping and pivoting said distortion bar 42. Furthermore such a rotation bar 42 shows that it represents a pivotal jet regulator 10 with a joint sleeve 2 adjustable at the outlet end, which the user usually is unaware of, because said feature has previously not been known. Furthermore, the direction of this rotation bar 42 shown in FIG. 24 indicates the direction of the outflowing water jet, so that with the aid of this adjustment bar pre-adjustments can be performed without it being controlled with the aid of the water jet.

Figure 25:
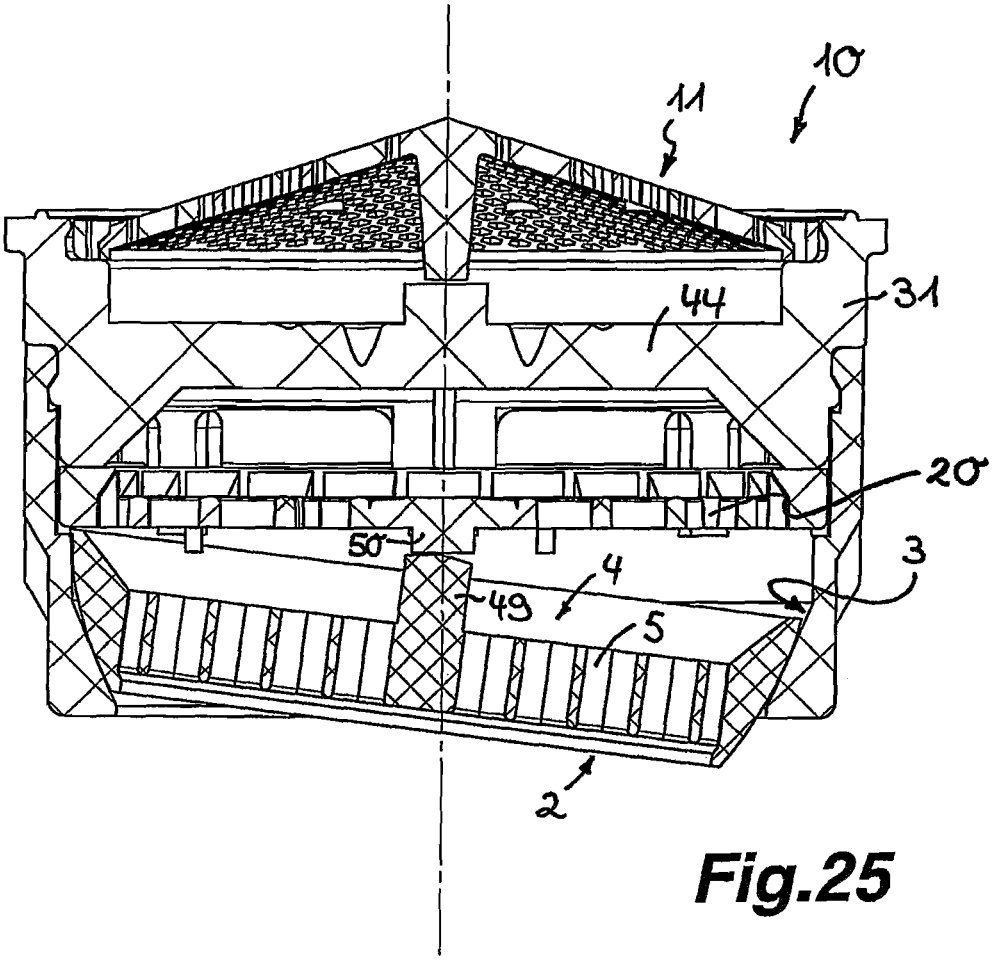

FIG. 25 shows another embodiment, in which the joint sleeve 2 does not move in a hollow-cap-shaped joint socket 3 but in which the cap-shaped joint sleeve 2 is arranged in a joint socket with an internal conical shape.

In all embodiments shown here it is possible to improve the seal between the joint sleeve 2 and the hollow-cap shaped or hollow-conical joint socket 3 such that the material of the joint socket 3 or preferably the material of the joint sleeve 2 comprises a water absorbent and thus swelling material. During operation, these parts are always moist or wet so that in reference to the assembly a pre-stressing occurs, in particular of the elastically embodied sealing edge at the upstream circumferential edge region of the joint sleeve 2. This leads to a constant pre-stress over the entire life of the product with a simultaneously simple assembly. Depending on the extent of the swelling this may even lead to a desired fixation and blockage of the joint sleeve 2 in the joint socket 3 during operation.

What is claimed is:

1. A sanitary insert (1), for a plumbing water outflow fitting, comprising a housing (8) and a flow guide (4), the housing (8) having a generally cylindrical shape, an inner wall portion thereof having a concavity (3) around its periphery, the flow guide (4) having generally a disc shape with an outer wall portion thereof having a convexity (2) around its perimeter, the housing (8) being configured to pivotally secure the flow guide (4) within it by a ball and socket type engagement thereby allowing an articulating movement of the flow guide (4) within the housing (8), the housing (8) being configured to be inserted into a plumbing outflow fitting, wherein at an upstream side of the flow guide at least one spacer is provided, which contacts an upstream arranged component, the spacer having a surface structure contour, which faces the component to define a pivot axis of the flow guide for pivotal movement of the flow guide in the housing.

2. The sanitary insert (1) according to claim 1, wherein pivoting of the flow guide (4) changes an orientation of a flow of water emerging therefrom.

3. The sanitary insert (1) according to claim 1, wherein the flow guide (4) is provided upstream with at least one inserted or implemented part (20).

4. The sanitary insert (1) according to claim 1, wherein the pivot axis of the flow guide (4) is formed by at least two spacers (40), spaced apart from each other, at an upstream end of the convexity (2) or the flow guide (4).

5. The sanitary insert (1) according to claim 4, wherein at least one of the spacers (40) has a semi-circular or polygonal surface contour.

6. The sanitary insert (1) according to claim 4, wherein at least one of the spacers (40) is provided, with a progression of a surface contour thereof determining the pivot axis, with at least one snapping protrusion (42) or an elevation defining a pivot position.

7. The sanitary insert (1) according to claim 1, wherein the flow guide (4) is supported for rotation in a circumferential direction in the housing (8).

8. The sanitary insert (1) according to claim 7, wherein a rotation bar (42) or handle protrudes downstream at the flow guide (4).

9. The sanitary insert (1) according to claim 8, wherein the rotation bar or handle (42) has an approximately coaxial or axis-parallel longitudinal extension in reference to a pivotal axis of the flow guide (4).

10. The sanitary insert (1) according to claim 1, wherein the convexity (2) contacts at least an internal perimeter of the concavity (3) with a pre-load on an inlet end in a circumferential edge region in a sealing manner.

11. The sanitary insert (1) according to claim 1, wherein a pivot axis of the flow guide (4) in the sleeve (8) is determined by two pivot pins (46) protruding at opposite sides of the concavity (3) or the convexity (2), which engage longitudinal grooves (45) of the respective other component (2, 3) in a rotatable manner.

* * * * *